US007930775B2

(12) United States Patent
Kluckhuhn

(10) Patent No.: US 7,930,775 B2
(45) Date of Patent: Apr. 26, 2011

(54) ROTARY GANTRY CRANE SYSTEM

(75) Inventor: Gary R. Kluckhuhn, Naples, FL (US)

(73) Assignee: IL Technologies Corporation, Naples, FL (US)

( * ) Notice: Subject to any disclaimer, the term of this patent is extended or adjusted under 35 U.S.C. 154(b) by 0 days.

(21) Appl. No.: 12/384,453

(22) Filed: Apr. 6, 2009

(65) Prior Publication Data

US 2010/0251478 A1 Oct. 7, 2010

(51) Int. Cl.
*A61G 7/10* (2006.01)
*A61G 7/14* (2006.01)
*B66C 17/00* (2006.01)

(52) U.S. Cl. ..... 5/85.1; 5/81.1 R; 5/83.1; 212/312

(58) Field of Classification Search ..... 5/81.1 R, 5/83.1, 84.1, 85.1, 87.1, 89.1; 212/312, 315–318, 212/324, 325
See application file for complete search history.

(56) References Cited

U.S. PATENT DOCUMENTS 2,272,778 A * 2/1942 Reuter ..... 5/85.1
4,202,064 A * 5/1980 Joergensen ..... 5/83.1
4,243,147 A * 1/1981 Twitchell et al. ..... 212/284
4,256,098 A * 3/1981 Swan et al. ..... 5/85.1
4,296,509 A * 10/1981 Simmons et al. ..... 5/85.1
4,372,452 A * 2/1983 McCord ..... 212/285
4,627,119 A * 12/1986 Hachey et al. ..... 5/85.1
4,639,955 A * 2/1987 Carminati et al. ..... 5/85.1
4,944,056 A * 7/1990 Schroeder et al. ..... 5/85.1
5,072,840 A * 12/1991 Asakawa et al. ..... 212/312
5,147,051 A * 9/1992 Liljedahl ..... 212/71
5,158,188 A * 10/1992 Nordberg ..... 212/312
5,337,908 A * 8/1994 Beck, Jr. ..... 212/312
5,456,655 A * 10/1995 Morris ..... 601/23
5,499,408 A * 3/1996 Nix ..... 5/85.1
5,511,256 A * 4/1996 Capaldi ..... 5/83.1
5,539,941 A * 7/1996 Fuller ..... 5/85.1
5,623,948 A * 4/1997 Van Morris ..... 5/81.1 R
5,809,591 A * 9/1998 Capaldi et al. ..... 5/83.1
7,237,491 B2 * 7/2007 Faucher et al. ..... 104/89
7,462,138 B2 * 12/2008 Shetty et al. ..... 482/69
7,506,589 B2 * 3/2009 Hjort ..... 104/126
2008/0271242 A1 * 11/2008 Hjort ..... 5/85.1

* cited by examiner

*Primary Examiner* — Robert G. Santos

(57) ABSTRACT

The inventive rotating gantry system consists of a welded tubular track tube which establishes a circular overhead track under which the rotating gantry rotates. There is a longitudinal elongated beam or support bar which extends beyond the periphery of the rotating gantry at both ends. The longitudinal elongated beam is rotating beneath the gantry by a four wheel cluster of rollers which surround the circular overhead track and run thereon. The elongated longitudinal beam has a moving trolley running there along and the moving trolley has attached thereto a vertical post which at a bottom thereof has a patient pick-up or transfer device. The rotating gantry can be suspended from a ceiling, be self-supporting or be attached to walls of a room be way of extendable extensions attached to the rotating gantry.

7 Claims, 6 Drawing Sheets

ROTARY GANTRY CRANE SYSTEM

BACKGROUND OF THE INVENTION

The invention relates to a patient pick up and transfer system That uses an overhead gantry crane system for lifting a recumbent or sitting person from one location to possibly a wheelchair or a gurney. Many sick or disabled persons are unable to get up by themselves and move to another location and require the assistance of an attendant to pick up this person in his or her arms.

DISCUSSION OF THE PRIOR ART

U.S. Pat. No. 6,711,759 which was developed by the inventor of this invention illustrates a system that is directed to the transport of an invalid person. The system is suspended from a ceiling and can move relative thereto. The system is so constructed that it can easily pick up a patient and transport the patient from one point to an another without having to move the patient, lift the patient and transport the patient by either an overhead conveyor mechanism or an apparatus that is movable on the ground.

BRIEF DESCRIPTION OF THE INVENTION

The present invention is a simplified version of all known prior art devices that is either mounted on a ceiling in a designated patient's room or it can be mounted against the walls of a patient's room or it can be moved from one room to another because it is self-supporting by supports legs and the system can easily be disassembled and be reconstructed in another room without the use of complicated tools. The pick-up system can move over the bed of a recumbent patient, pick up the patient and then move the patient from the bed location to either a gurney or a wheelchair at the bedside location. The patient transfer system consists of a welded tubular ring under which a gantry crane rotates. There is a bridge beam suspended from the tubular ring by a roller system. This bridge beam is movable relative to the tubular ring to a cantilevered position beyond the diameter of the tubular ring.

DETAILED DESCRIPTION OF THE INVENTION

Figure 1:
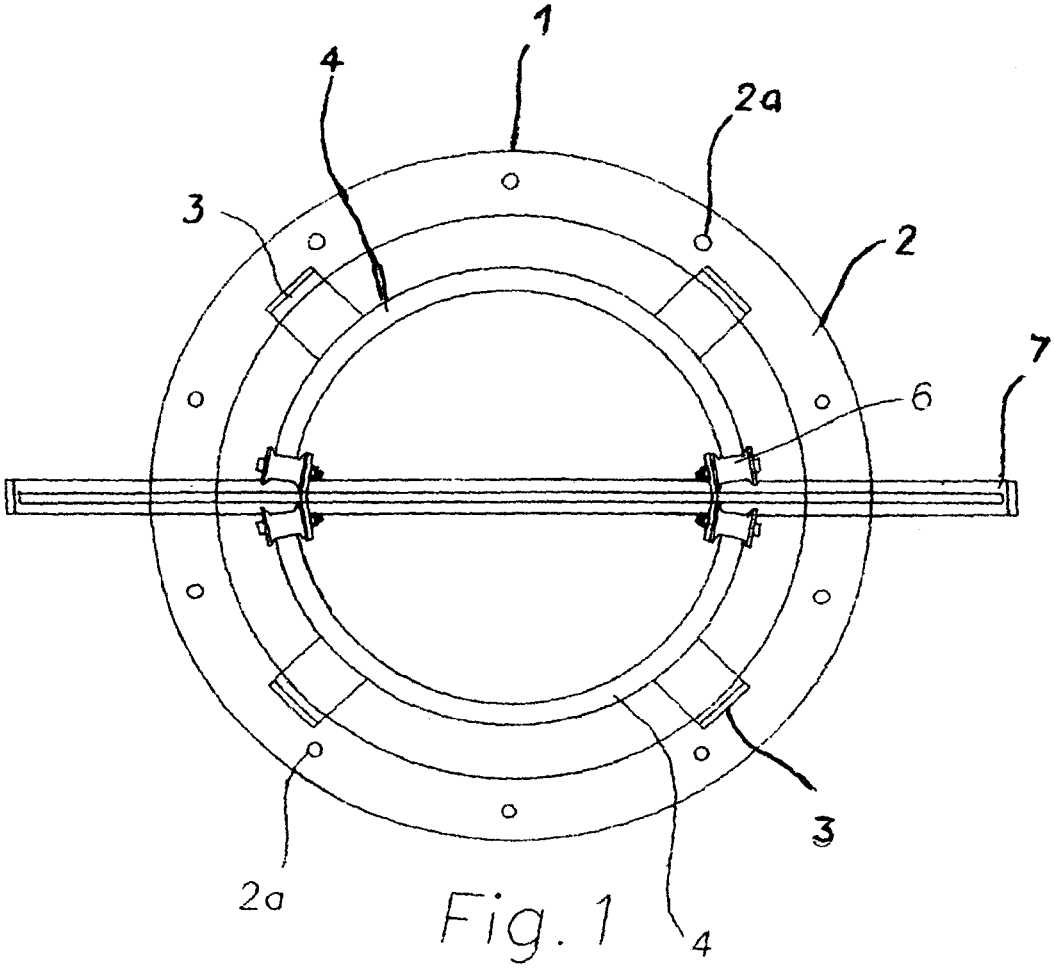
FIG. 1 is a top view of the rotary gantry.

FIG. 1 illustrates the rotary gantry 1 in a top view. The rotary gantry consists of a narrow circular support plate 2 that may be mounted against the ceiling in a designated patient's room and above a patient's bed in the room. Just below the circular plate 2 there is located a tubular, circular and hollow track element 4 which is supported to the circular plate by way of several latches 3. The circular support plate 2 has holes 2*a* therein to be able to be mounted to the ceiling. There is a cross bar 5 straddling the circular tube. The cross bar 5 has at each of its ends attached thereto a roller system 6 which will run or roll around the circular tube 4 when so induced. The roller system 6 consists of a cluster of four rollers 6*a* which embrace the circular tube 4 so as to be in constant contact with the circle of the tube 4. Attached to the cross bar 5 is another support bar 7 which extends beyond the periphery of the circular tube 4. The support bar 7 is attached to the cross bar 5 by way of angle irons 7*a*.

Figure 1A:
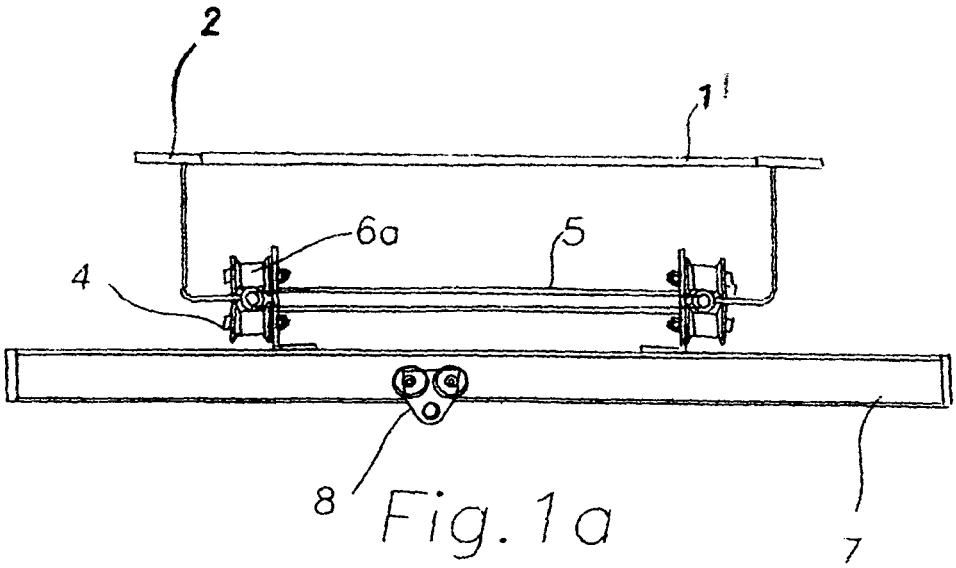
FIG. 1A is a side view of the rotary gantry of FIG. 1.

FIG. 1A is a side view of the gantry depicted in a top view in FIG. 1. The same reference characters have been applied to this Fig. as were in FIG. 1 and the general layout of this side view is self-explanatory. An additional element can be seen in this side view and that is a trolley 8 which will run in the U-shaped support bar 7 by way of its wheels or rollers 8*a*. As will be explained below, the trolley will run along the U-shaped track of the support bar 7 even to a point where it is a cantilevered position relative to gantry 1. The trolley 8 will receive a vertical post 9 (FIG. 3) which will be instrumental in helping to pick up and transport a person.

Figure 2:
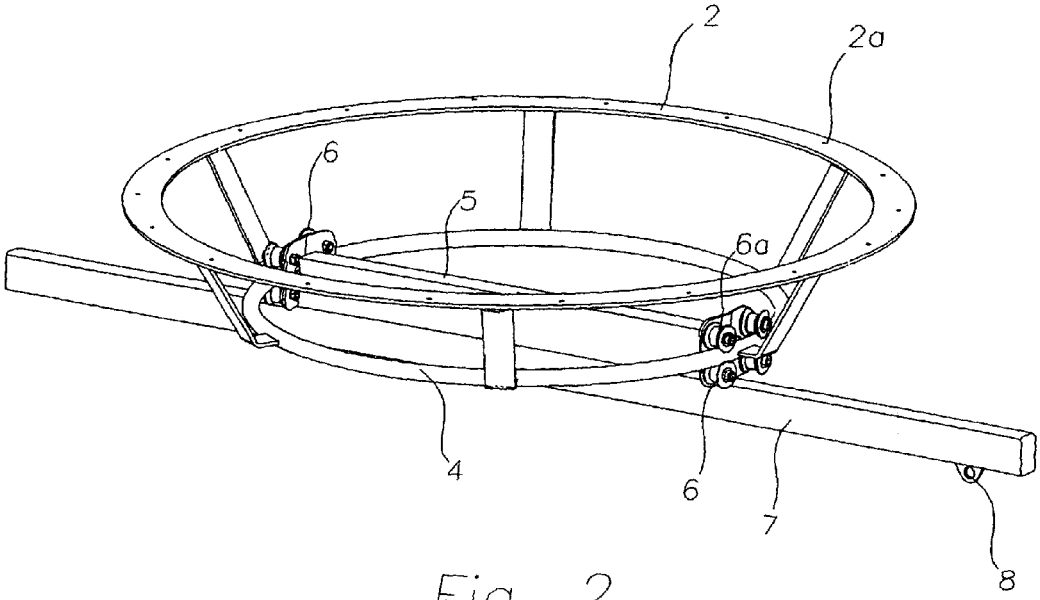
FIG. 2 is a perspective view of the gantry of FIG. 1.
Figure 3:
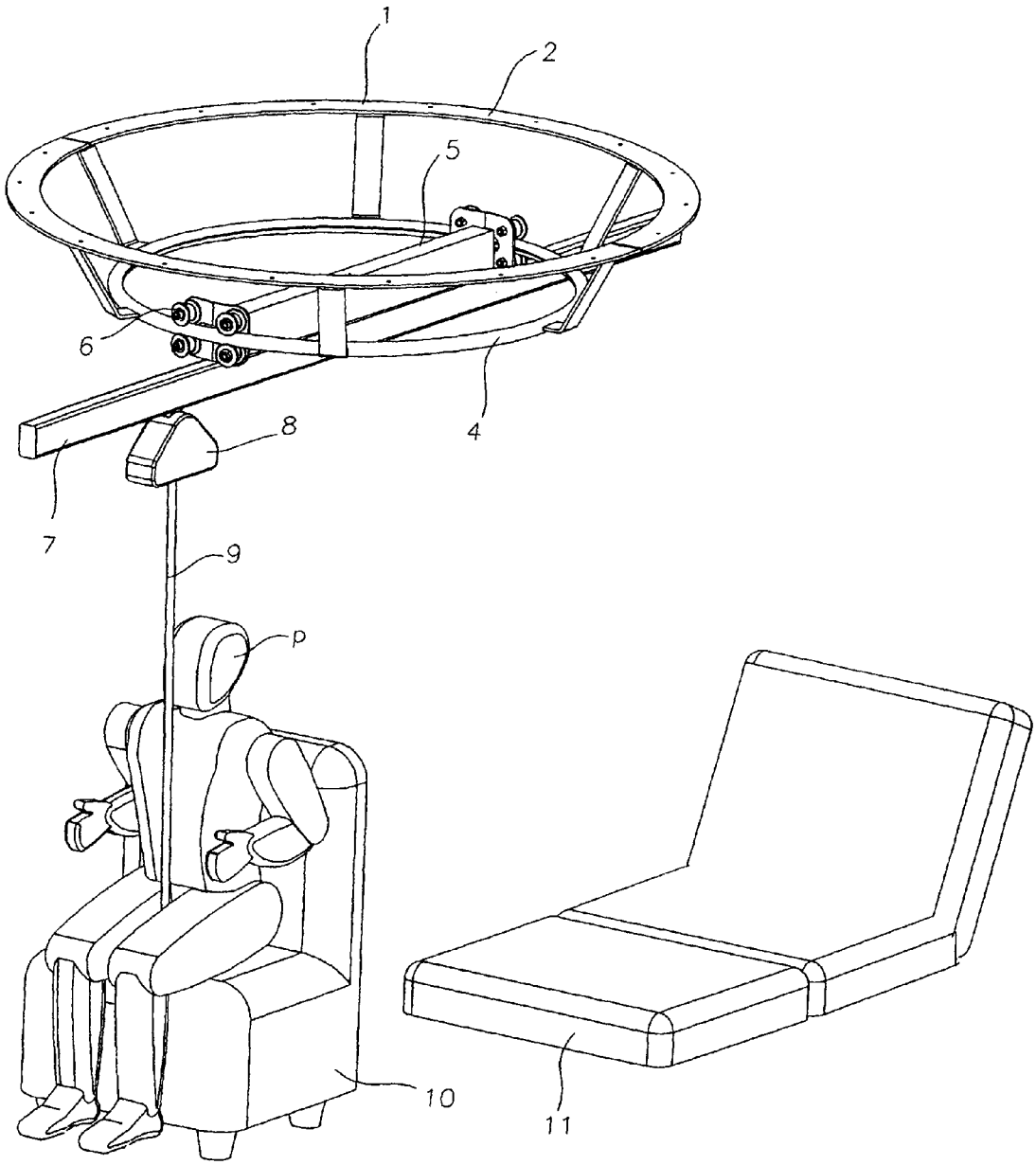
FIG. 3 illustrates the use of the gantry in a person pick-up position.

FIG. 3 is perspective view of the transport gantry so far explained in FIGS. 1 and 2. Again, the same reference characters have been applied to the various elements of the inventive structure as were explained above. In this perspective view there is shown the vertical post 9 which is attached to the traveling trolley 8 which can travel in the U-shaped support bar 7. As explained above, the support bar 7 will extend beyond the periphery of the circular gantry 1 for the reason that a person P that has been picked from bed 11 or is to be moved to a chair 10 has the proper latitude to travel the extra distance required to accomplish the task at hand.

Figure 4:
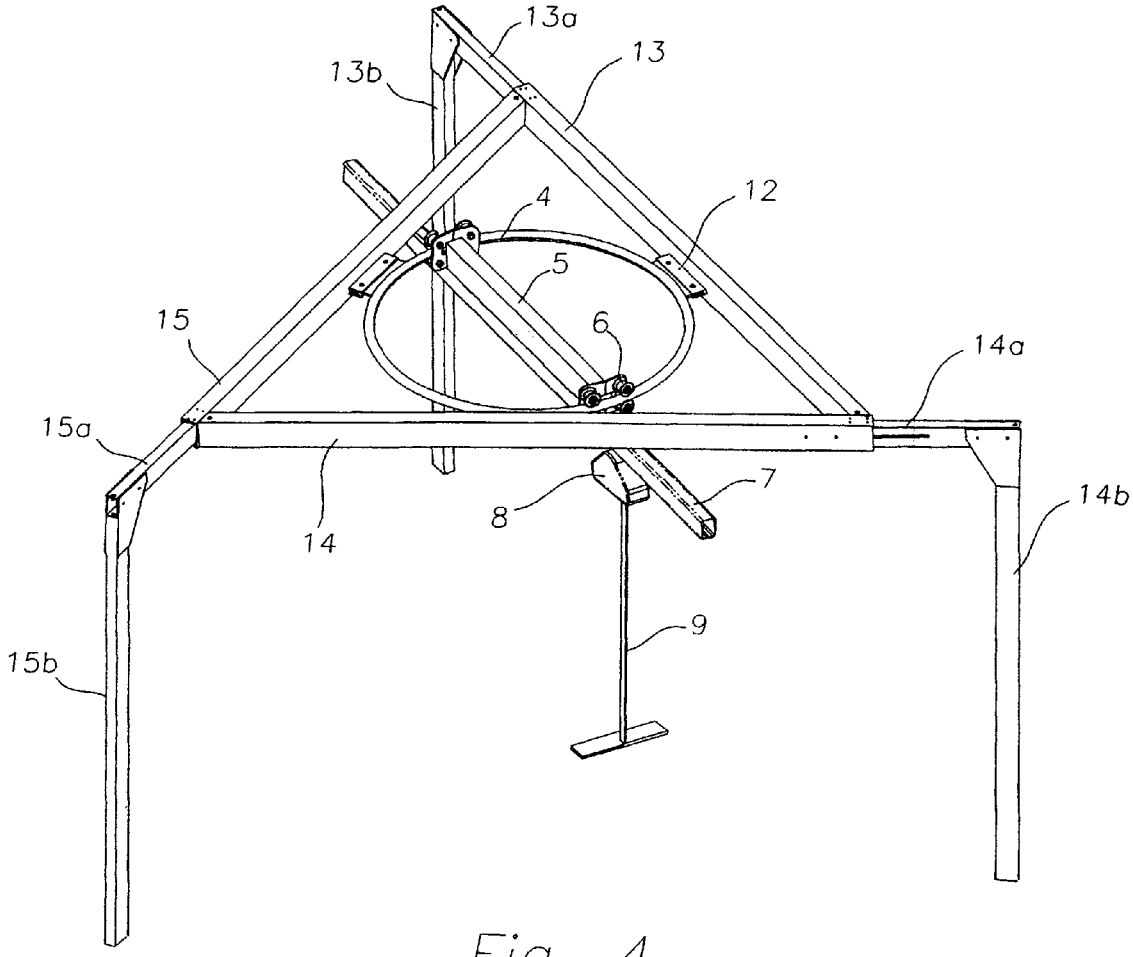
FIG. 4 shows the rotating gantry self-supported by legs.

FIG. 4 is a perspective view of a different mounting of the gantry 1 wherein the ceiling mount ring 2 has been omitted and the circular tube 4 has been mounted to a triangular support system consisting of three bars 13, 14 and 15. Each of the bars have an extendable subsection 13*a*, 14*a* and 15*a*. These extendable subsections can accommodate different room sizes and different patient requirements. Overall, this gantry system is self-supporting by use of the legs 13*b*, 14*b* and 15*b*. This way, the gantry system can be moved and can be assembled anywhere there is a need and most of all the assembly and disassembly requires a minimum of tools. Note how the support beam still extends beyond the periphery of the gantry circular tube 4. This is important because there has to be enough space for the patient to be lifted in or our a gurney or a wheel chair and onto the hospital bed for the patient.

Figure 5:
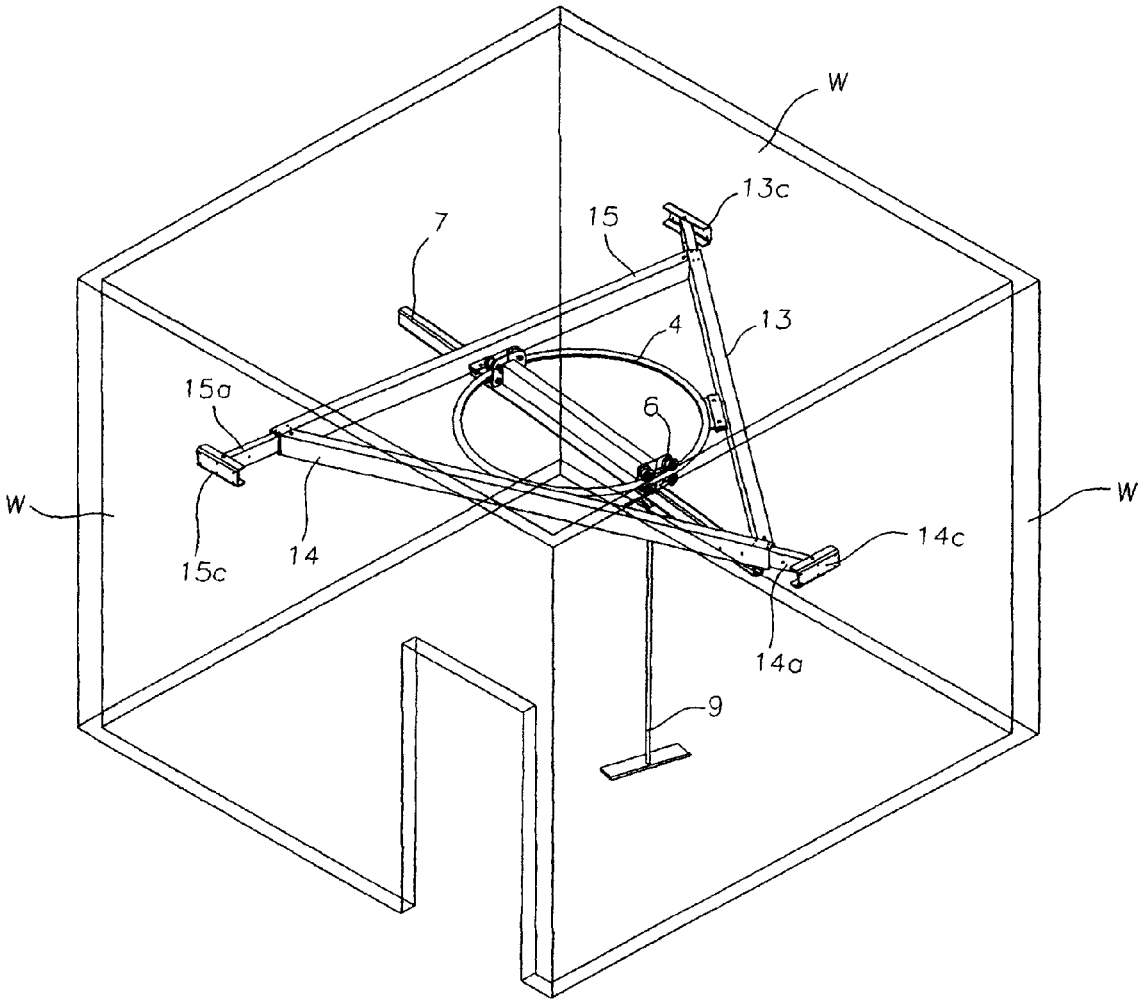
FIG. 5 illustrates the gantry being mounted against adjacent walls.

FIG. 5 illustrates yet another mounting system of the gantry. The circular tubular track 4 is again mounted to three support bars 13, 14 and 15 (as shown in FIG. 4) forming a triangular support. The support bars also have the extendable sections 13*a*, 14*a* and 15*a*. which can extend in and out of the support bars 13, 14 and 15, respectively. In this embodiment the support bars are extended to by flush against respective walls where the ends of each of the support bars 13, 14 and 15 can be mounted against a vertical wall W by way of the wall mounts 13*c*, 14*c* and 15*c*. This type of mounting allows for a proper centering of the gantry above a patient's bed. Again note that the support bar 7 can be extended past the periphery of the gantry tube 4 in a cantilever fashion. This arrangement is an important part of the invention at hand.

Figure 6:
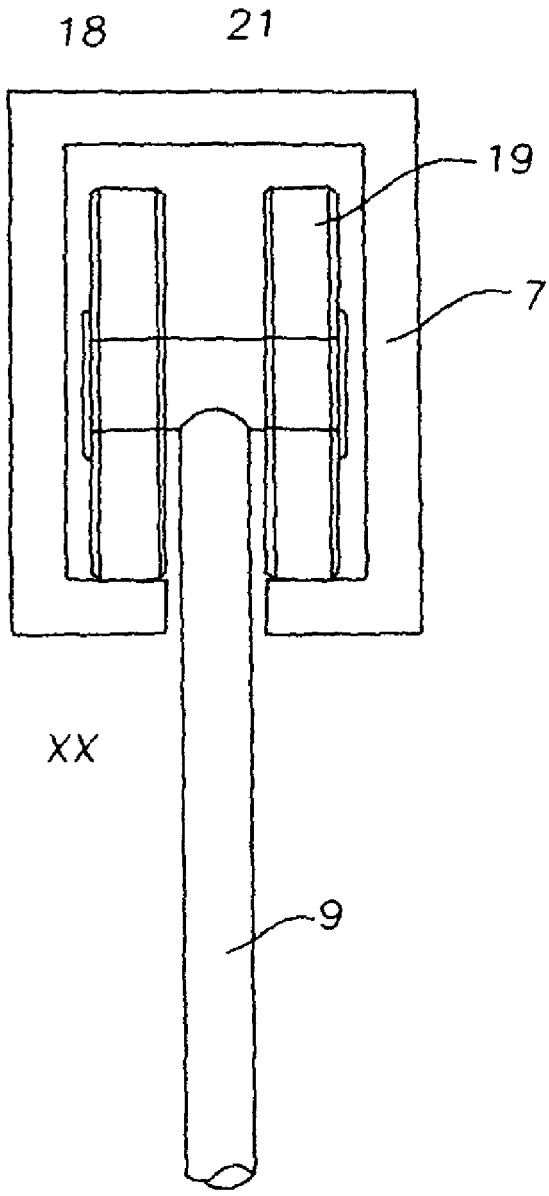
FIG. 6 illustrates a different embodiment of the tubular track.

FIG. 6 illustrates a different type of construction for the gantry circular tube. In this embodiment there is shown a different construction for the wheel assembly 6 (FIG. 2). Instead of four wheels running on the circular tube as is shown above, the tube 7 has a bottom slot 17 therein allowing access to the interior of the tube 7. In this embodiment there are located two wheels 18 and 19 which are connected to each other by way of an axle 21. The two wheels will run on the inside surface of the tube 7 and are properly guided and stabilized by way of the depending post 9 which supports a patient transportation system. As can be seen the tube 4 can take the shape of a rectangle.

As can be seen now, there has been disclosed a simple but effective patient transfer and transport system. The various elements can easily be moved by a hand because of the rollers 6, the trolley rollers 8*a* and the second embodiment rollers 18 and 19. However, various electric motors could be employed to accomplish the movement of the various elements by a remote control system. This would increase the cost of the construction of the gantry system to some extent. An aim of the inventive concept is to construct a low cost but effective gantry system which can easily be moved to different locations if so desired.

What I claim is:

1. A rotary gantry system comprising a hollow and circular track tube, means for mounting said hollow track tube above a patient in a room, said circular track tube is mounted to bars which are connected to said means for mounting said hollow tube above said patient, means for rotating a longitudinal support bar relative to said circular track tube, said longitudinal support bar has a trolley operating at an underside thereof, a vertical post is attached to said trolley, said vertical post has means thereon and at a bottom thereof to transport a patient, said trolley can move on said longitudinal support bar to a position which is beyond the periphery of said circular hollow tube in a cantilever fashion.

2. The rotary gantry system of claim 1, wherein said means for mounting said hollow track tube above a patient is a circular ring plate mounted against a ceiling.

3. The rotary gantry system of claim 1, wherein said means for mounting said hollow track tube above a patient are support bars attached to said hollow track tube and extending to walls in a room and fastened thereto.

4. The rotary gantry system of claim 1, wherein said means for mounting for mounting said hollow track tube above a patient are support bars attached to said hollow track tube, said support bars have legs supporting said support bars on a floor in a room.

5. The rotary gantry system of claim 4, wherein said support bars have means thereon for extending the same to different lengths.

6. The rotary gantry system of claim 1, wherein said means for rotating said longitudinal support bar relative to said hollow track tube is a cluster of rollers surrounding said hollow track tube, a roller cluster is attached to said longitudinal support bar at each end thereof.

7. The rotary gantry system of claim 1, wherein said means for rotating said longitudinal support bar relative to said hollow track tube is a slot through said hollow track tube and a roller system is located within the interior of said hollow track tube, said vertical post is attached to said rollers system.

* * * * *